US012264662B2

(12) United States Patent
Wen

(10) Patent No.: US 12,264,662 B2
(45) Date of Patent: Apr. 1, 2025

(54) PORTABLE ELECTRIC INFLATOR

(71) Applicant: Shenzhen Fanttik Technology Innovation Co., Ltd., Shenzhen (CN)

(72) Inventor: Mingrong Wen, Shenzhen (CN)

(73) Assignee: SHENZHEN FANTTIK TECHNOLOGY INNOVATION CO., LTD., Shenzhen (CN)

( * ) Notice: Subject to any disclaimer, the term of this patent is extended or adjusted under 35 U.S.C. 154(b) by 234 days.

(21) Appl. No.: 18/142,019

(22) Filed: May 1, 2023

(65) Prior Publication Data

US 2024/0369051 A1 Nov. 7, 2024

(51) Int. Cl.

| | |
|---|---|
| ***F04B 35/06*** | (2006.01) |
| ***A47C 27/08*** | (2006.01) |
| ***F04B 35/04*** | (2006.01) |
| ***F04B 39/12*** | (2006.01) |
| ***F04D 25/06*** | (2006.01) |
| ***F04D 25/08*** | (2006.01) |

(52) U.S. Cl.

CPC ..... *F04B 35/06* (2013.01); *A47C 27/082* (2013.01); *F04B 35/04* (2013.01); *F04B 39/12* (2013.01); *F04B 39/121* (2013.01); *F04D 25/0673* (2013.01); *F04D 25/084* (2013.01)

(58) Field of Classification Search

CPC ..... F04B 35/04; F04B 35/06; F04B 39/121; F04B 39/12; F04D 25/0673; F04D 25/084; A47C 27/082

See application file for complete search history.

(56) References Cited

U.S. PATENT DOCUMENTS

| | | | | |
|---|---|---|---|---|
| 5,478,211 | A * | 12/1995 | Dominiak | A61M 39/281 607/153 |
| 5,782,611 | A * | 7/1998 | Neftel | A61M 5/1413 417/313 |
| 6,257,847 | B1 * | 7/2001 | Silver | F04B 45/047 604/74 |
| 10,731,637 | B2 * | 8/2020 | Walmsley | F04B 35/06 |
| 11,178,976 | B2 * | 11/2021 | Adams | A61G 7/05792 |
| 2022/0110768 | A1 * | 4/2022 | Ballas | A61F 2/7843 |

* cited by examiner

*Primary Examiner* — Peter J Bertheaud

(57) ABSTRACT

A portable electric inflator includes: a core assembly including a motor and an air compressing mechanism, the motor configured to drive the air compressing mechanism to compress and discharge air; a housing defining a receiving space for accommodating the core assembly, and having an external surface that defines a display receiving hole and a number of through holes communicating with the receiving space; a cloth in full contact with and covering the external surface of the housing, the cloth defining an opening, an edge of the opening extending from a junction of the display receiving hole and the external surface of the housing into the housing, forming a side surface covering portion that is in contact with an inner side surface of the display receiving hole; and a display received in the display receiving hole, the display comprising a lateral surface abutting against the side surface covering portion.

19 Claims, 19 Drawing Sheets

PORTABLE ELECTRIC INFLATOR

TECHNICAL FIELD

The present disclosure generally relates to inflators, and particularly to a portable electric inflator.

BACKGROUND

Inflators have been widely used in people's lives, and they can be used to inflate tires of automobiles, motorcycles, and bicycles, rubber balls, and rubber boats, etc. Many electric inflators use the rotary motion of a motor to drive a piston to reciprocate in a cylinder and compress the air in the cylinder to achieve the purpose of inflation.

With the high-level requirements of the market and product competitiveness, users hope that the inflators have higher inflation efficiency, that is, the time for inflating an object (e.g., a tire) is required to be shorter and shorter. However, in some conventional inflators, improving the inflation efficiency is generally achieved by increasing the output rotational speed of the motor, that is, increasing the speed at which the piston compresses the air in the cylinder. However, this approach will also have a negative impact on the inflator, i.e., the increase of heat and noise, which results in poor user experience. The housing of some portable air pumps has a high temperature at the motor and cylinder, and is even hot, which is not conducive to users to hold. The housing of some inflators is slippery, which is not conducive to users to hold, and it is easy for the inflators to slip out of user's hands.

Some inflators realize heat dissipation by arranging cooling holes on their housing or using metal cooling fins. The cooling holes or cooling fins are visible to users, which is not conducive to the simple and esthetic appearance of the inflators.

The motor shaft inside some inflators is generally provided with fan blades. When the motor shaft rotates, it drives the fan blades to rotate, thereby increasing the air flow, allowing the air to accelerate into the inflators and take away the internal heat, which can cool the surfaces of the inflators. However, the housing of the inflators has heat dissipation holes and is not dust-proof. When used in some harsh environments, there is a risk of tiny foreign objects being sucked into the inside of the inflators. In severe cases, it may damage the seal between the motor/cylinder and the piston, which will affect the inflation efficiency and service life of the inflators.

Therefore, there is a need to provide a portable electric inflator to overcome the above-mentioned problems.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

FIG. 1S is an enlarged view of a portion E shown in FIG. 14.

DETAILED DESCRIPTION

Figure 1:
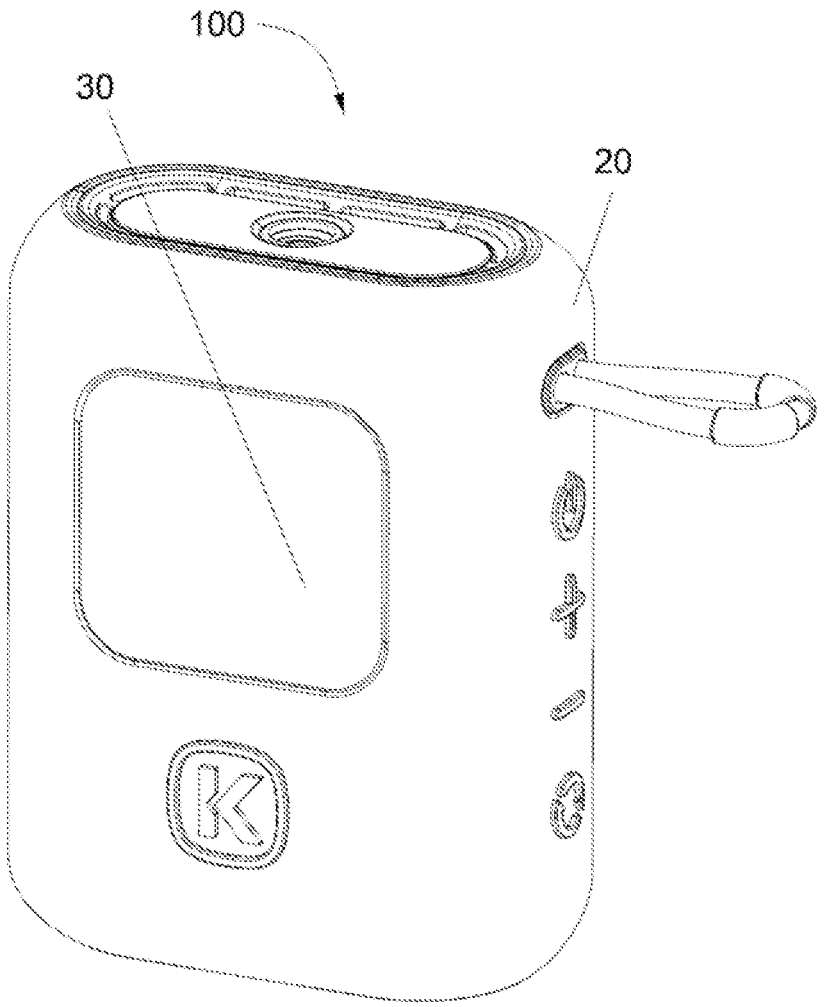
FIG. 1 is an exemplary isometric view of a portable electric inflator according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

The housing of the inflator of the present disclosure is covered with a layer of cloth. By selecting the cloth of suitable material, such as cloth with characteristics including anti-slip, dust-proof, water-repellent, breathable, heat-insulating, sound-insulating, wear-resistant, dirt-resistant, ultraviolet-resistant, fire-proof, flame-retardant, and excellent hand feel, it can bring the following positive effects to the inflator.

1. Increase the user's grip when using the inflator, and it is not easy for the inflator to slip from the user's hand;
2. Prevent external foreign particles and dust from entering the interior of the inflator and damaging the internal parts of the inflator;
3. Adapt to the harsh outdoor environments;
4. Esthetic appearance. Due to the regular texture of the cloth itself, the screws and ventilation holes or metal heat sinks on the external surface of the housing of the inflator are not visible after the external surface of the housing is covered with cloth;

5. Heat insulation and anti-scalding, reduce the heat inside the inflator transferred to a user's hand;
6. Sound insulation and noise reduction;
7. Prevent the housing of the inflator from being scratched; and
8. Keep the appearance of the inflator durable and not easy to fade.

Figure 2:
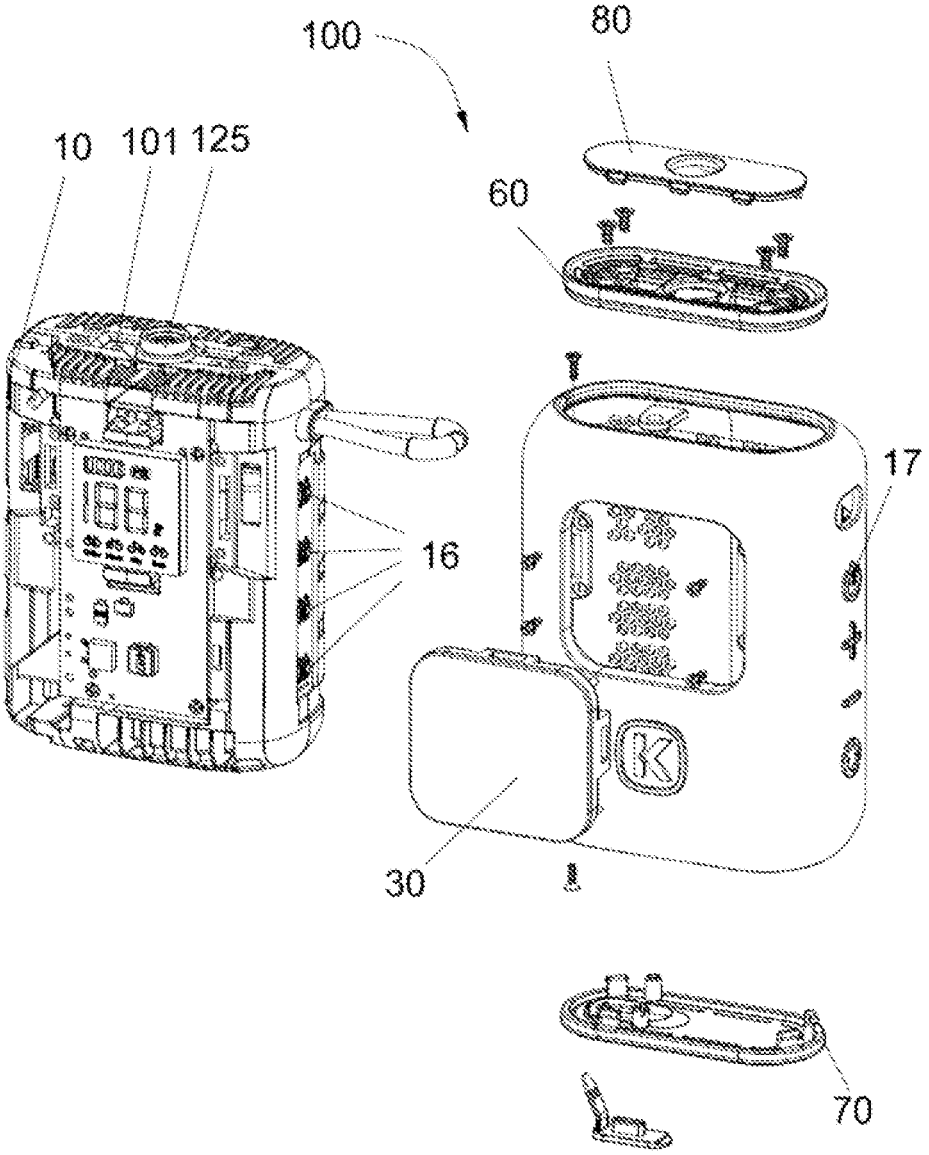
FIG. 2 is an exploded view of the portable electric inflator according to one embodiment.

Referring to FIGS. 1 and 2, in one embodiment, a portable electric inflator 100 has a compact shape, which is easy for users to carry, and can inflate tires of cars, motorcycles, and bicycles, rubber balls, and rubber boats, etc. The inflator 100 may include a core assembly 10 and a housing 40. Optionally, the inflator 100 may further include a display 30. The core assembly 10 is fully accommodated in the housing 40, and the display 30 is detachably connected to the housing 40 or the core assembly 10, and is to display information such as air pressure and current working mode.

Figure 3:
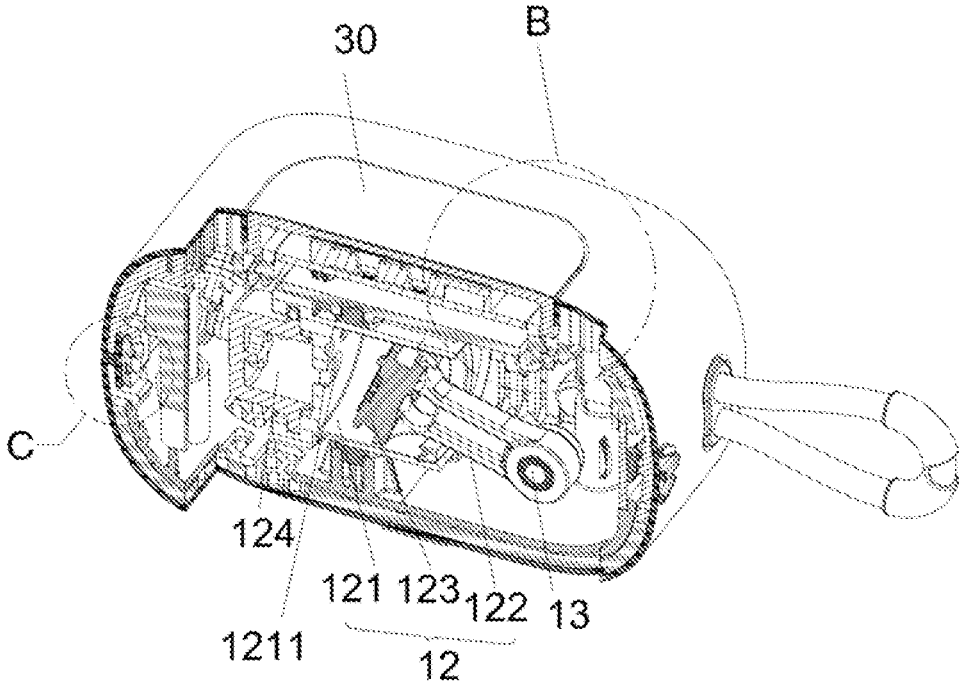
FIG. 3 is an isometric cross-sectional view of the portable electric inflator.
Figure 4:
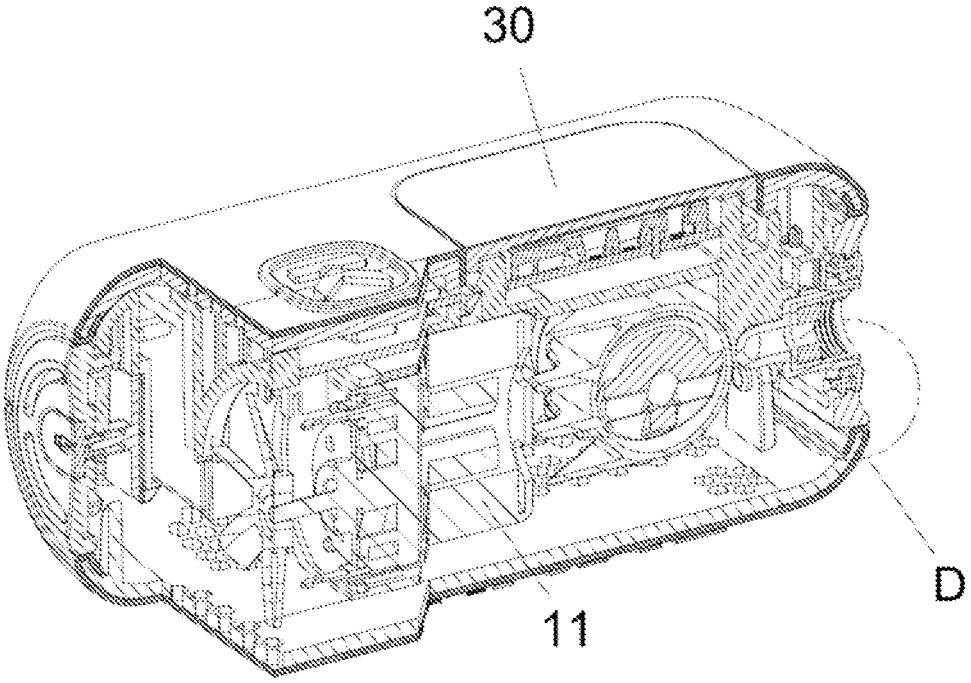
FIG. 4 is another isometric cross-sectional view of the portable electric inflator.

Referring to FIGS. 2 and 3, in one embodiment, the core assembly 10 may include a motor 11 (see FIG. 4) and an air compressing mechanism 12. Driven by the motor 10, the air compressing mechanism 12 compresses the air and then discharges it. The motor 11 can be directly connected with the air compressing mechanism 12. In one embodiment, the motor 11 is connected to the air compressing mechanism 12 through a transmission mechanism 13. Specifically, the motor shaft of the motor 11 is connected to the input component of the transmission mechanism 13, and the output component of the transmission mechanism 13 is connected to the air compressing mechanism 12.

In one embodiment, the air compressing mechanism 12 may include a cylinder 121, a piston rod 122 accommodated in the cylinder 121, and a piston 123 connected to one end of the piston rod 122. The output component of the transmission mechanism 13 is connected with end of the piston rod 122 opposite to the piston 123, and the transmission mechanism 13 transmits the rotational motion from the motor 11 to the piston rod 122. That is, the rotational motion of the motor shaft of the motor 11 is converted into the swing of the piston rod 122, causing the piston rod 122 to push the piston 123 to reciprocate in the cylinder 121 to compress and discharge the air in the cylinder 121.

In one embodiment, the transmission mechanism 13 may be a gear transmission device, which includes a gear set including one or more pairs of gears. For example, the transmission mechanism may include a pinion gear fixed on the motor shaft of the motor 11 and a bull gear meshed with the pinion gear. The end face of the bull gear is provided with a shaft offset from its axis of rotation. The end of the piston rod 122 opposite to the piston 123 is provided with a shaft hole, and the shaft is rotatably connected to the shaft hole. When the motor is in operation, the motor shaft drives the pinion gear to rotate coaxially, and then drives the bull gear to rotate. The shaft rotates around the axis of rotation of the bull gear, thereby driving the end of the piston rod 122 to swing repeatedly. The piston rod 122 can thus push the piston 123 to reciprocate in the cylinder 121 to compress and discharge the air in the cylinder 121. The gear transmission is a well-known technology, and its details will not be discussed here.

It should be noted that the transmission mechanism 13 is not limited to the above-mentioned configuration, and other conventional transmission devices can be selected according to actual needs.

The end of the cylinder 121 opposite to the piston 123 defines a through hole 1211, and the core assembly further includes an air storage chamber 124 that communicates with the cylinder 121 through the through hole 1211. The reciprocating movement of the piston 123 in the cylinder 121 pushes the air in the cylinder into the air storage chamber 124, and the air storage chamber 124 communicates with an air outlet 125. When in use, the user can connect the object to be inflated (such as a tire) with the air outlet 125 through a hose, so that the air flowing out of the air outlet 125 flows to the object to be inflated along the hose.

Figure 18:
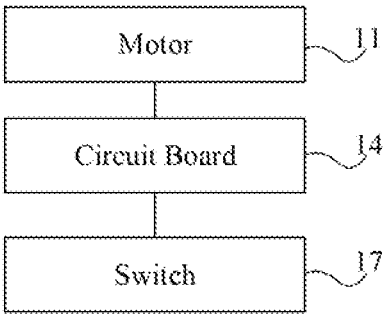
FIG. 18 is a schematic block diagram of the inflator according to one embodiment.

The core assembly 10 may further include a circuit board 14 (see FIG. 18), and the motor 11 is electrically connected to the circuit board 14. The circuit board 14 performs control of the motor 11 in response to user input, for example, in response to the user pressing a button on the external surface of the housing 40. The circuit board 14 can start the motor 11, turn off the motor 11, adjust the output speed of the motor 11, etc.

It should be noted that the core assembly 10 may further include other components related to the motor 11 and the air compressing mechanism 12, such as air pressure detection components, etc., which will not be discussed here.

Figure 5:
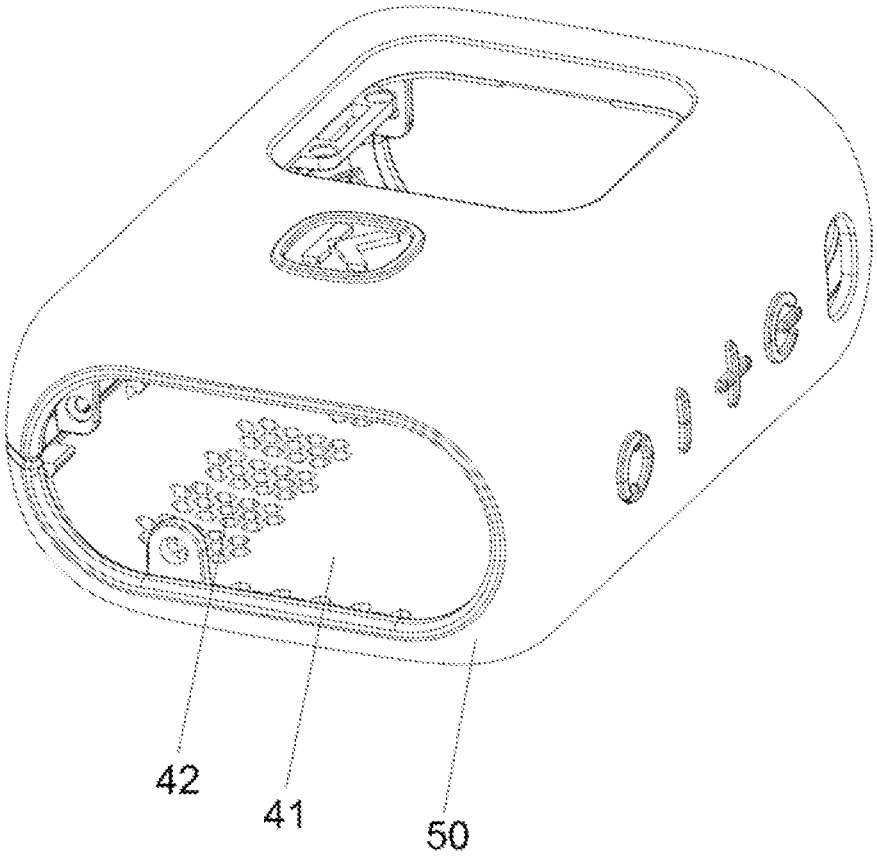
FIG. 5 is an isometric view of a housing assembly including a housing and a cloth covering the housing according to one embodiment.
Figure 6:
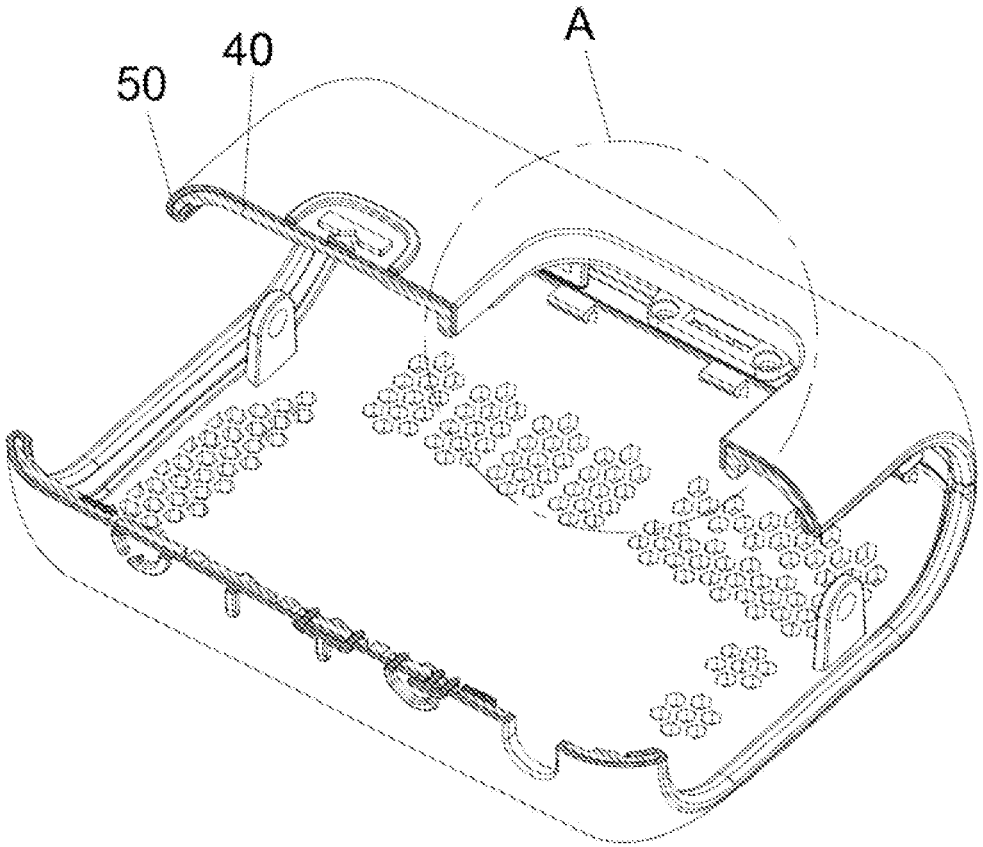
FIG. 6 is an isometric cross-sectional view of the housing assembly of FIG. 5.

Referring to FIGS. 5 and 6, in one embodiment, the inflator 100 may further include a cloth 50 covering the housing 40. In this embodiment, the core assembly 10 is in the shape of a cuboid as a whole. Corresponding to the structure of the core assembly, the housing 40 needs to provide an internal receiving space 41 that is roughly a cuboid. The external surface 4001 (see FIG. 9) of the housing 40 defines a number of through holes 42 communicating with the receiving space 41. The through holes 42 allow the heat generated by the core assembly 10 to dissipate from the inside of the housing 40 to the outside of the housing 40.

Figure 7:
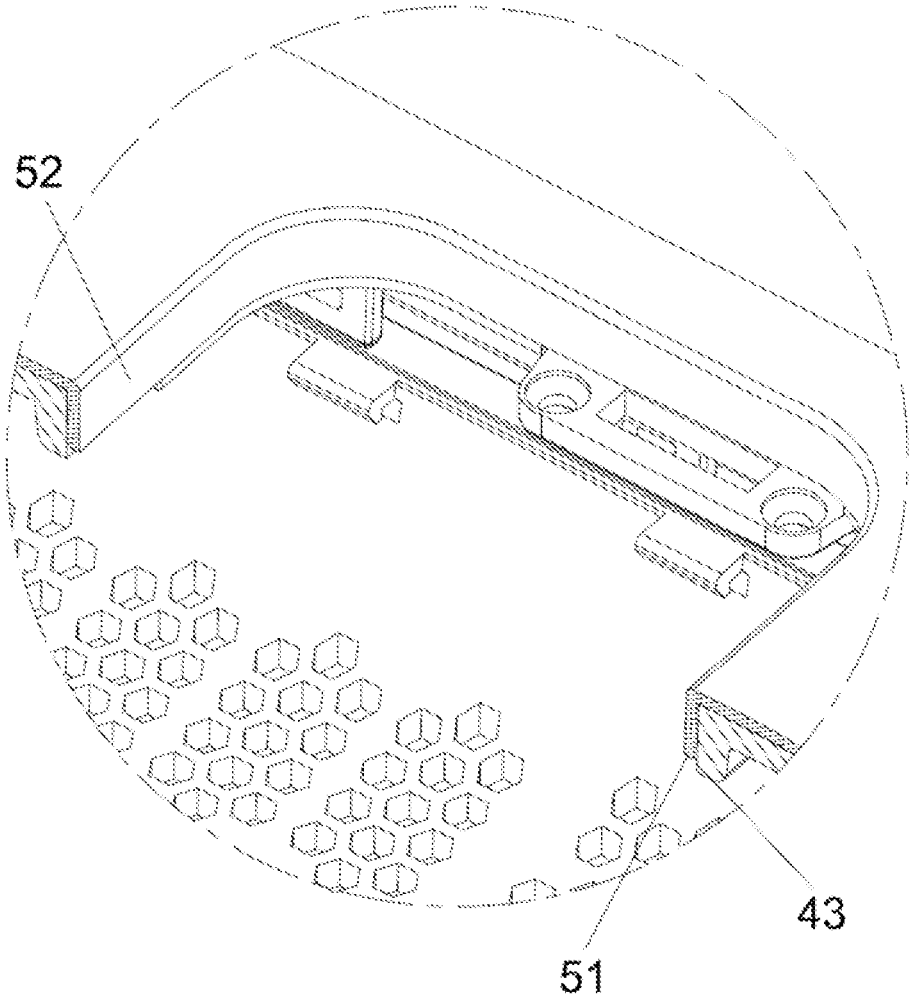
FIG. 7 is an enlarged view of a portion A shown in FIG. 6.
Figure 8:
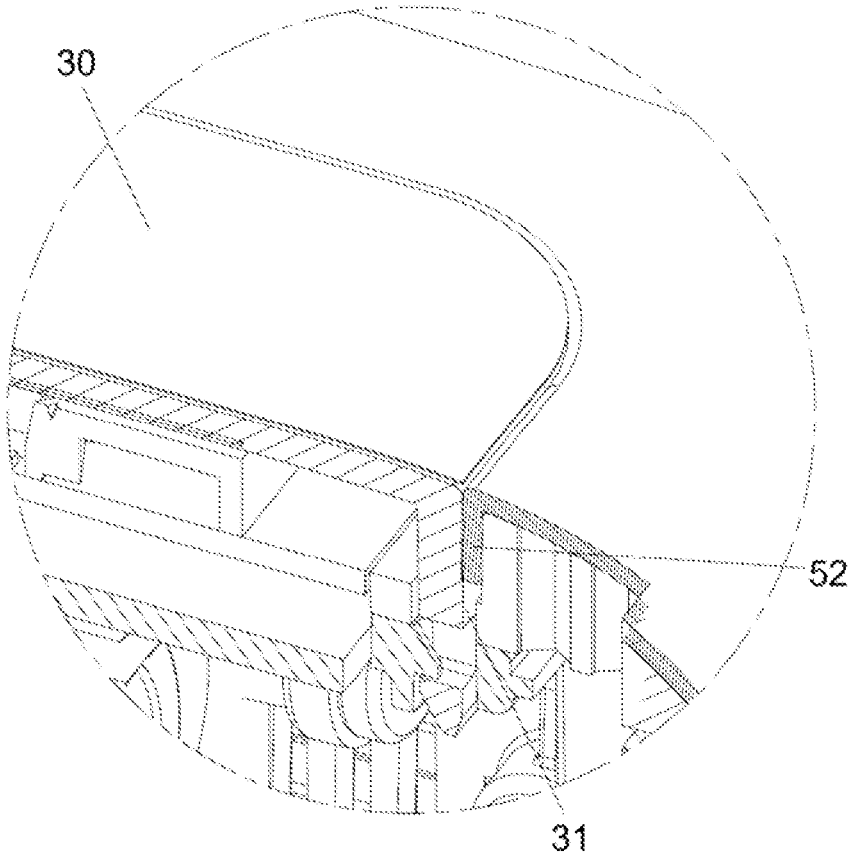
FIG. 8 is an enlarged view of a portion B shown in FIG. 3.
Figure 9:
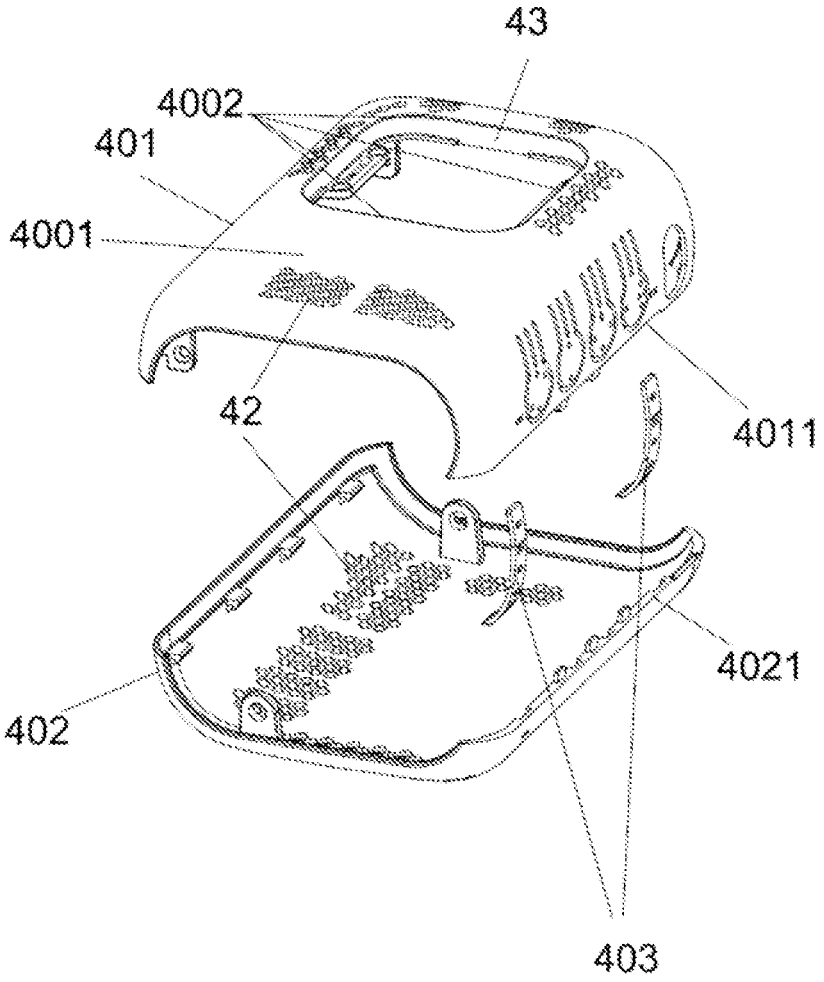
FIG. 9 is an exploded view of the housing of the inflator according to one embodiment.
Figure 19:
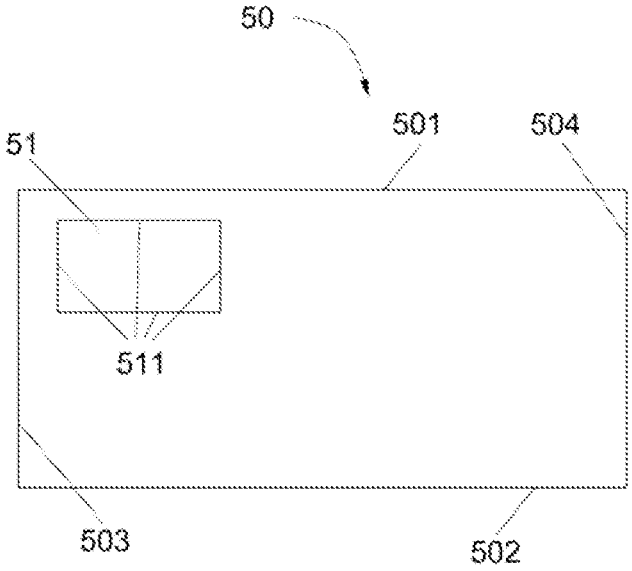
FIG. 19 is a schematic diagram of the cloth covering the housing of the inflator according to one embodiment.

Referring to FIGS. 6 and 7, in one embodiment, when the inflator 100 is equipped with the display 30, a display receiving hole 43 communicating with the receiving space 41 is defined in the external surface 4001 of the housing 40 (see FIG. 9). The cloth 50 is in full contact with and covers the external surface 4001 of the housing 40. The cloth 50 defines an opening 51. Referring to FIG. 19, in one embodiment, the cloth 50 can be rectangular and includes a first long edge 501, a second long edge 502, a first short edge 503, and a second short edge 504. In one embodiment, the display receiving hole 43 is rectangular. Correspondingly, the opening 51 is rectangular. An edge 511 of the opening 51 extends from a junction 4002 (see FIG. 9) of the display receiving hole 43 and the external surface 4001 of the housing 40 into the housing 40, thereby forming a side surface covering portion 52 that is in contact with an inner side surface of the display receiving hole 43. The display 30 is accommodated in the display receiving hole 43, and the side surface 31 of the display 30 abuts against the side surface covering portion 52 (see FIG. 8). In one embodiment, the side surface covering portion 52 can be fixed on the inner side surface of the display receiving hole 43 by glue.

Figure 10:
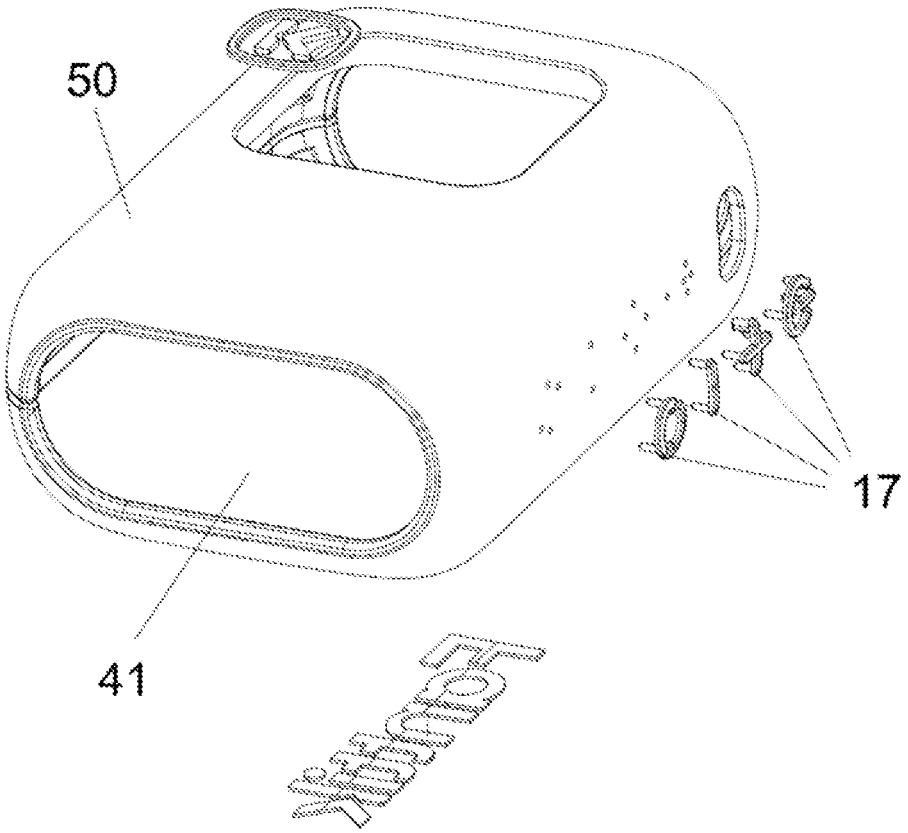
FIG. 10 is a partial exploded view of the housing assembly of FIG. 5.

Referring to FIGS. 9 and 10, in one embodiment, the housing 40 includes a first housing 401 and a second housing 402 connected to each other. Both the first housing 401 and the second housing 402 can be made of plastic, and both include a flat plate and side walls protruding from the flat plate. When the first housing 401 and the second housing 402 are connected to each other, their flat plates and side walls corporately form the receiving space 41. In one embodiment, when the inflator 100 is equipped with the display 30, the display receiving hole 43 can be arranged in the first housing 401. In addition, the first housing 401 and the second housing 402 may both be provided with through holes 42 for heat dissipation. It can be seen from FIGS. 9 and 10 that after the cloth 50 wraps the first housing 401 and the second housing 402, the through holes 42 becomes invisible, which is beneficial to improve the aesthetics of the inflator 100.

Figure 11:
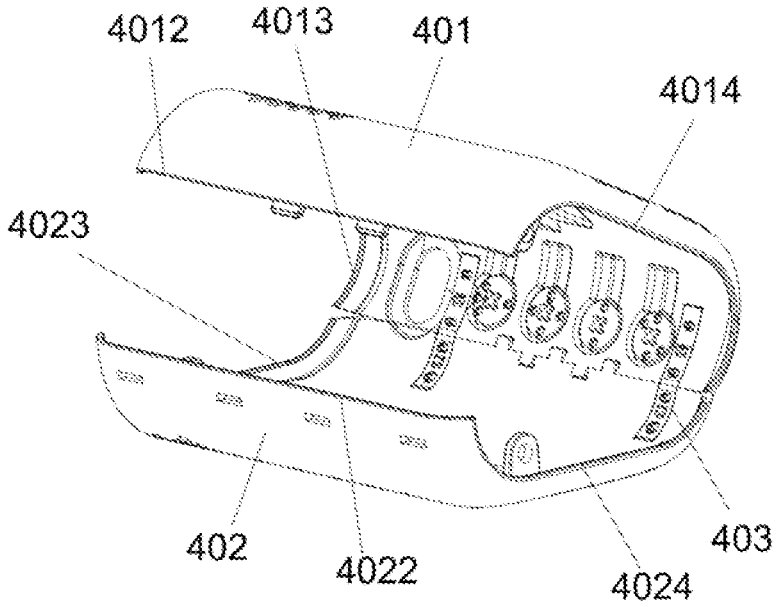
FIG. 11 is an isometric view of the housing of FIG. 9 in an open state.

Referring to FIGS. 9 and 11, in one embodiment, the first edge 4011 of the first housing 401 is rotatably connected to the first edge 4021 of the second housing 402. The cloth 50 is in full contact with and covers the external surface of the first housing 401 and the external surface of the second housing 402. Edges (i.e., the first short edge 503, a first portion of the first long edge 501, and a first portion of the second long edge 502) of the cloth 50 extend from the second edge 4012 of the first housing 401 opposite to the first edge 4011, the third edge 4013 and the fourth edge 4014 between the first edge 4011 and the second edge 4012 of the first housing 401 to the inner surface of the first housing 401. Edges (i.e., the second short edge 504, a second portion of the first long edge 501, and a second portion of the second long edge 502) of the cloth 50 extend from the second edge 4022 of the second housing 402 opposite to the first edge 4021, the third edge 4023 and the fourth edge 4024 between the first edge 4021 and the second edge 4022 of the second housing 402 to the inner surface of the second housing 402, which can be seen in FIGS. 12 and 13.

Figure 12:
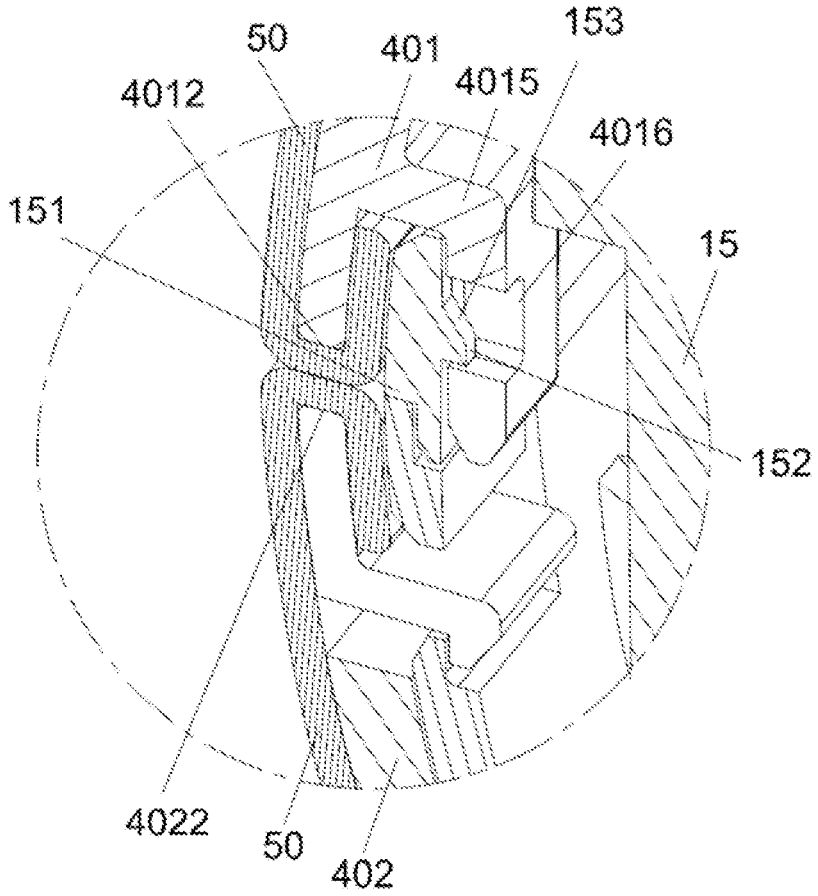
FIG. 12 is an enlarged view of a portion C shown in FIG. 3.
Figure 13:
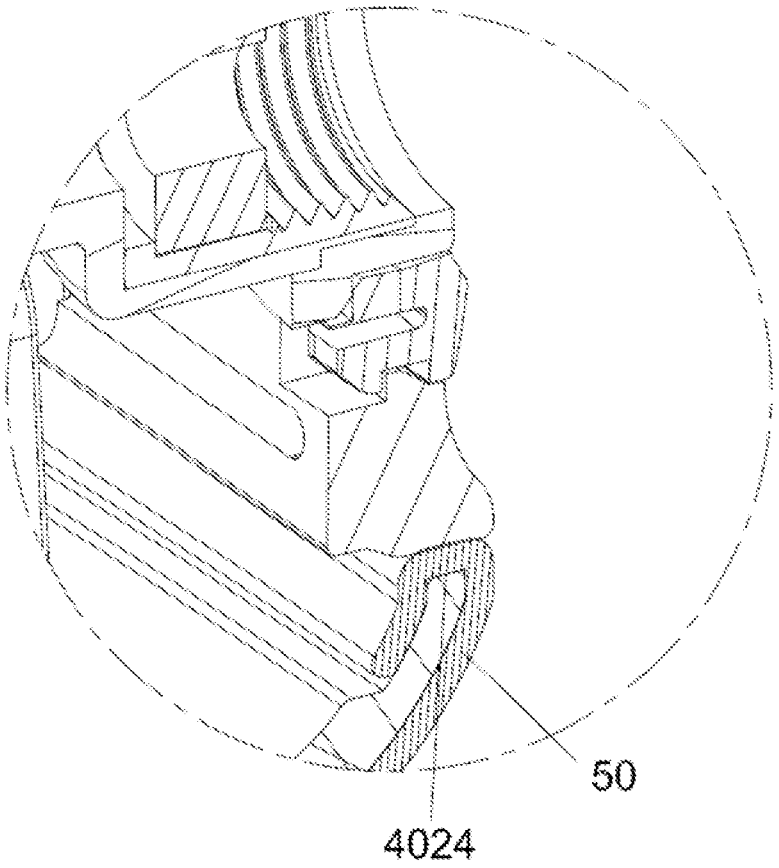
FIG. 13 is an enlarged view of a portion D shown in FIG. 4.

In other words, the first short edge 503 of the cloth 50 extends from the second edge 4012 of the first housing 401 to the inner surface of the first housing 401, and the second short edge 504 of the cloth 50 opposite to the first short edge 503 extends from the second edge 4022 of the second housing 402 to the inner surface of the second housing 402. The first long edge 501 of the cloth 50 between the first short edge 503 and the second short edge 504 extends from the third edge 4013 of the first housing 401 and the third edge 4023 of the second housing 402 to the inner surfaces of the first housing 401 and the second housing 402. The second long edge 502 of the cloth 50 between the first short edge 503 and the second short edge 504 extends from the fourth edge 4014 of the first housing 401 and the fourth edge 4024 of the second housing 402 to the inner surfaces of the first housing 401 and the second housing 402. The portion of the cloth 50 that is in contact with the inner surfaces of the first housing 401 and the second housing 402 may be fixed to the inner surfaces of the first housing 401 and the second housing 402 by glue. As shown in FIGS. 3 and 12, when the first housing 401 and the second housing 402 are in the closed state shown in FIG. 12, The portion of the cloth 50 covering the second edge 4012 of the first housing 401 abuts against the portion of the cloth 50 covering the second edge 4022 of the second housing 402.

Referring to FIGS. 9 and 11, in one embodiment, the first housing 401 and the second housing 402 are rotatably connected to each other through a flexible hinge 403. In this case, the first edge 4011 of the first housing 401 and the first edge 4021 of the second housing 401 face each other, and abut against each other when the first housing 401 and the second housing 402 are in the closed state shown in FIG. 10. With this configuration, when assembled, the first housing 401 and the second housing 402 can be rotated to an open position similar to that shown in FIG. 11, which allows the core assembly 10 to be placed in the space between the first housing 401 and the second housing 402.

In one embodiment, the number of the flexible hinges 403 is two in one embodiment. It should be noted that the number of the flexible hinges 403 may vary according to actual needs. In one embodiment, the flexible hinges 403 can be made of flexible plastic. In one embodiment, each flexible hinge 403 is roughly in the shape of a square strip.

Figure 14:
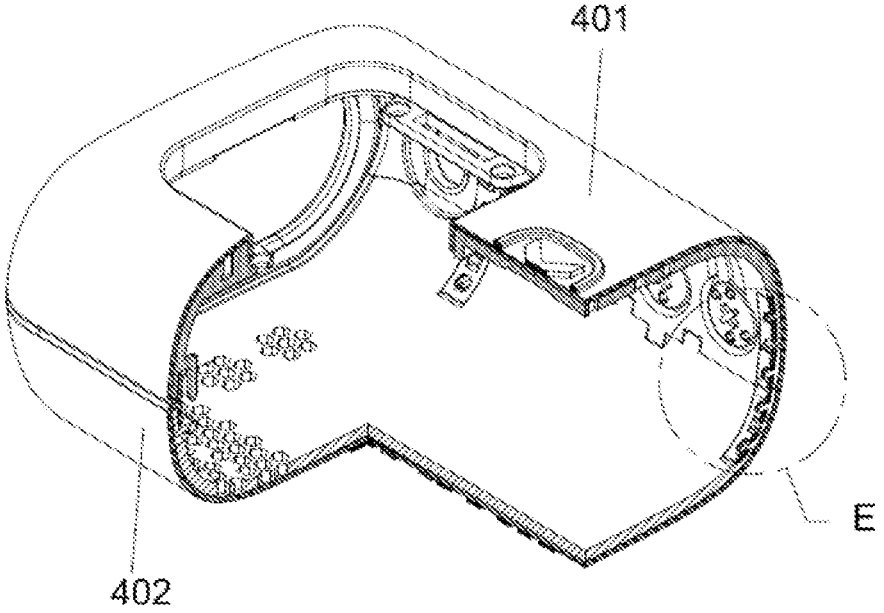
FIG. 14 is an isometric sectional view of the housing assembly of FIG. 5.
Figure 15:
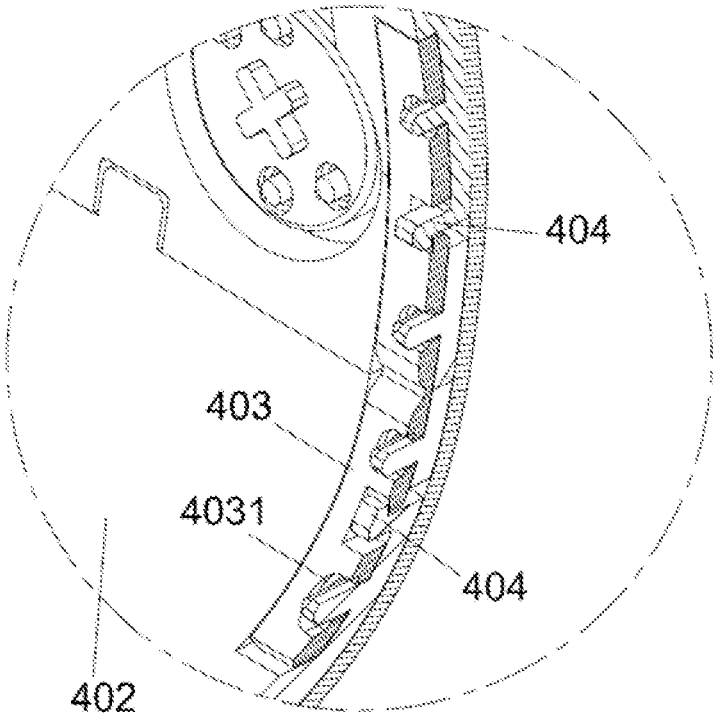

Referring to FIGS. 9, 14, and 15, in one embodiment, each flexible hinge 403 defines a number of through holes 4031, and a number of posts 404 protrude from the inner surfaces of the first housing 401 and the second housing 402. The ends of the posts 404 pass through the through holes 4031 of one flexible hinge 403. Each flexible hinge 403 is fixed to the first housing 401 and the second housing 402 after the ends of the posts 404 are heat fused.

It should be noted that the first housing 401 and the second housing 402 can be rotatably connected to each other through other connection techniques. For example, the first housing 401 and the second housing 402 may both be provided with shaft holes, and the first housing 401 and the second housing 402 are rotatably connected together by a shaft passing through the shaft holes.

Referring to FIGS. 3 and 12, in one embodiment, the first housing 401 is provided with a first engaging member 4015 on its inner surface near its second edge 4012. The core assembly 10 includes a first counterpart member facing the first engaging member 4015. The first engaging member 4015 is engaged with the first counterpart member so as to detachably connect the first housing 401 to the core assembly 10. Specifically, the first engaging member 4015 includes a horizontal wall protruding from the inner surface of the first housing 401 and a vertical wall extending from the horizontal wall toward the second housing 402, and a through hole 4016 is defined in the vertical wall. The first counterpart member is arranged on a housing 15 that accommodates the motor 11 and the air compressing mechanism 12, and the first counterpart member is a side plate 151 spaced apart from the end surface of the housing 15. A protrusion 152 protrudes from a surface of the side plate 151 facing the end surface of the housing 15. The protrusion 152 includes a guiding plane 153 inclined downward from the surface of the side plate 151 facing the end surface of the housing 15. During the rotation of the first housing 401 from the open position shown in FIG. 11 to the closed position shown in FIG. 10, the vertical wall of the first engaging member 4015 gradually moves into the space between the side plate 151 and the end surface of the housing 15. During this process, the end of the vertical wall of the first engaging member 4015 contacts the inclined guiding plane 153 and moves downward along the guiding plane 153. During this process, the vertical wall of the first engaging member 4015 elastically deflects until the protrusion 152 is accommodated in the through hole 4016 on the vertical wall, and then the vertical wall restores to its original shape. Thus, the first housing 401 is fixed to the core assembly 10 by the first engaging member 4015 being engaged with the first counterpart member.

Similarly, the second housing 402 is provided with a second engaging member near its second edge 4022 on its inner surface, and the core assembly 10 includes a second counterpart member facing the second engaging member. The second engaging member is engaged with the second counterpart member, so that the second housing 402 is detachably fixed to the core assembly 10.

Referring to FIGS. 2, 9, and 10, in one embodiment, at least one switch 16 is provided on one side of the core assembly 10. The switch 16 is electrically connected to the circuit board 14, and in response to the switch 16 being triggered, the circuit board 14 performs the control of the motor 11. For example, in response to the switch 16 being triggered, the circuit board 14 can start the motor 11, turn off the motor 11 or adjust the output speed of the motor 11, etc.

Figure 16:
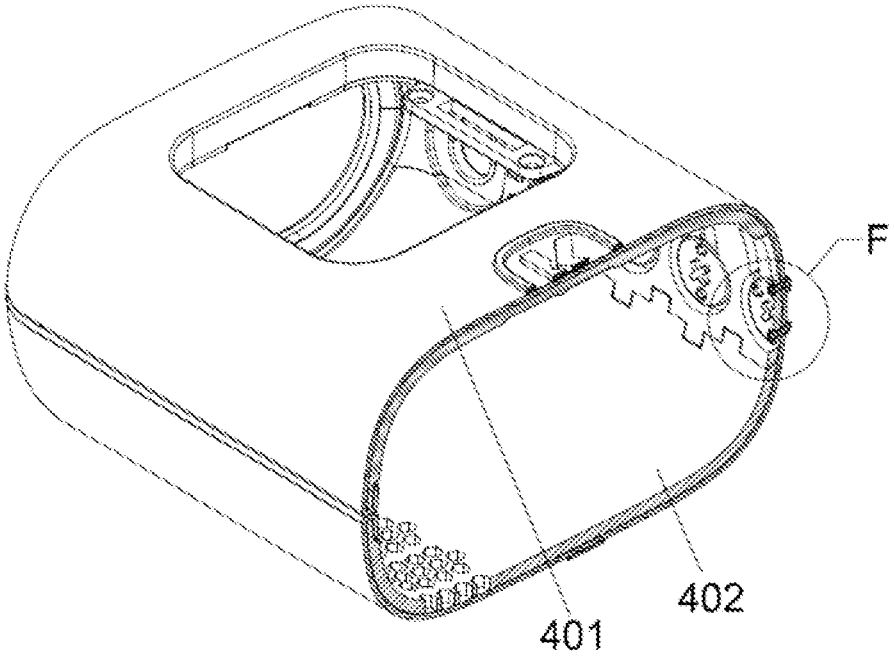
FIG. 16 is a cross-sectional view of the housing assembly of FIG. 5.
Figure 17:
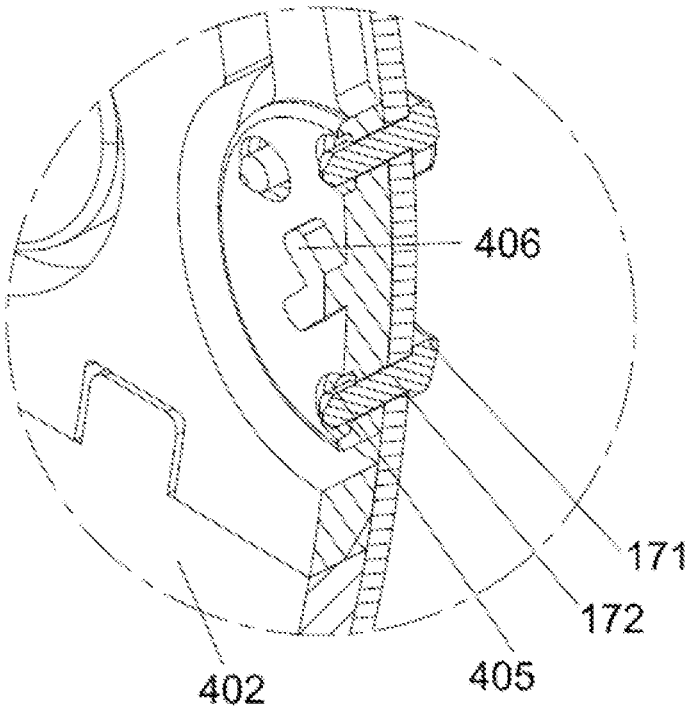
FIG. 17 is an enlarged view of a portion F shown in FIG. 16.

Referring to FIGS. 16 and 17, in one embodiment, corresponding to the switch 16, the inflator 100 further includes at least one button 17. The button 17 includes a body 171 and a fixing post 172 protruding from the back side of the body 171. The fixing post 172 passes through the cloth 50 and is connected to the housing 40. The button 17 is to receive a pushing force from a user and transmit the pushing force to the switch 16 to trigger the switch 16.

Referring to FIGS. 16 and 17, in one embodiment, the housing 40 defines a through hole 405 through which the fixing post 172 passes, and the end of the fixing post 172 is heat fused to connect the button 17 to the housing 40.

Referring to FIGS. 16 and 17, in one embodiment, a protruding post 406 is provided on the inner surface of the housing 40 at a position corresponding to the button 17. The protruding post 406 faces the switch 16 and is spaced a small distance from the switch 16. After the button 17 is pressed by the user, the portion of the housing 40 corresponding to the button 17 is pushed by the button 17 to elastically deform, so that the protrusion 406 moves toward the switch 16 until the switch 16 is triggered.

In one embodiment, the display 30 can be fixed to the core assembly 10 by means of snap-fit connection similar to the above-mentioned snap-fit connection that connects the first housing 401 to the core assembly 10. Snap-fit connections typically includes a small protrusion (i.e., a male component such as a hook, bead, or bump) that deflects during assembly to snap into a female element (i.e., a depression) on the mating part. Snap connections come in many variations, including cantilever, torsional and annular.

Referring to FIGS. 2 and 6, when the first housing 401 and the second housing 402 are in the closed state shown in FIG. 10, opposite ends of the housing 40 are open ends. In order to cover the open ends, the inflator 100 also includes an upper end cover 60 and a lower end cover 70 correspondingly. In one embodiment, the upper end cover 60 may be fixed to the top of the core assembly 10 by fasteners (such as screws), and the lower end cover 70 may be fixed to the bottom of the movement 10 by snap-fit connection. For example, a fixing technique (i.e., snap-fit connection) similar to that of the above-mentioned first housing 401 being fixed to the core assembly 10 is adopted.

In one embodiment, the top of the core assembly 10 is provided with a light emitting element 101 (e.g., a light emitting diode), and the upper end cover 60 defines a through hole to allow the light emitted by the light emitting element 101 to pass through. In one embodiment, the inflator 100 may further include a transparent light cover 80, which can be fixed to the upper end cover 60 by means of snap-fit connection. For example, a fixing technique (i.e., snap-fit connection) similar to that of the above-mentioned first housing 401 being fixed to the core assembly 10 is adopted.

The assembly process of the inflator 100 is as follows: firstly, the first housing 401 and the second housing 402 are connected to each other through the flexible hinges 403. Specifically, the ends of the posts 404 on the first housing 401 and the second housing 402 respectively pass through the through holes 4031 of the flexible hinges 403, and then the ends of the posts 404 are heat fused, so that the first housing 401 and the second housing 402 are rotatably connected to each other. Then, the external surfaces of the first housing 401 and the second housing 402 are covered with the cloth 50. The edges of the cloth 50 are folded at the edges of the first housing 401 and the second housing 402 so that the edges of the cloth 50 extend to the inner surfaces of the first housing 401 and the second housing 402. Specifically, the first short edge 503 of the cloth 50 extends from the second edge 4012 of the first housing 401 to the inner surface of the first housing 401, and the second short edge 504 of the cloth 50 opposite to the first short edge 503 extends from the second edge 4022 of the second housing 402 to the inner surface of the second housing 402. The first long edge 501 of the cloth 50 between the first short edge 503 and the second short edge 504 extends from the third edge 4013 of the first housing 401 and the third edge 4023 of the second housing 402 to the inner surfaces of the first housing 401 and the second housing 402. The second long edge 502 of the cloth 50 between the first short edge 503 and the second short edge 504 extends from the fourth edge 4014 of the first housing 401 and the fourth edge 4024 of the second housing 402 to the inner surfaces of the first housing 401 and the second housing 402. The portion of the cloth 50 that adheres to the inner surfaces of the first housing 401 and the second housing 402 is fixed to the inner surfaces of the first housing 401 and the second housing 402 by glue.

Then, the fixing post 172 of each button 17 is passed through the cloth 50 and connected to the housing 40. Specifically, the fixing post 172 of each button 17 is passed through the cloth 50 and through a corresponding through hole 40S on the housing 40. The end of each fixing post 172 is heat fused, thereby connecting the buttons 17 to the housing 40.

Then, after the assembly 20 composed of the housing 40 and the cloth 50 is opened at a certain angle (similar to the state shown in FIG. 11), the core assembly 10 is placed into the assembly 20. The first housing 401 and the second housing 402 are pushed to rotate to the closed state shown in FIG. 5. During this process, the vertical wall of each first engaging member 4015 of the first housing 401 gradually moves into the space between the side plate 151 and the end surface of the housing 15. During this process, the end of the vertical wall of each first engaging member 4015 contacts the inclined guiding plane 153 and moves downward along the guiding plane 153. During this process, the vertical wall of each first engaging member 4015 elastically deflects until the protrusion 152 is accommodated in the through hole 4016 on the vertical wall, and then the vertical wall rebounds. Thus, the first housing 401 is fixed to the core assembly 10 by the first engaging member 4015 being engaged with the first counterpart member. Similarly, during rotation of the first housing 401 and the second housing 402 to the closed state shown in FIG. 5, the second housing 402 is also connected to the core assembly 10 by snap-fit connection.

Then, after the first housing 401 and the second housing 402 are initially fixed by snap-fit connection, the through holes on the fixing tabs that are located near the top and bottom of the second housing 402 and protruding from the inner surface of the second housing 402 are aligned with the threaded holes in the core assembly 10, and the through holes on the fixing tabs protruding from the inner surface of the display receiving hole 41 of the first housing 401 is aligned with the threaded holes on the front of the core assembly 10. A number of screws are passed through the through holes in the above-mentioned fixing tabs one by one and screwed into the threaded holes, so that the first housing 401 and the second housing 402 are firmly fixed to the core assembly 10.

Then, the upper end cover 60 is fixed to the top of the core assembly 10 by screws, and the light cover 80 is fixed to the upper end cover 60 by snap-fit connection.

Then, the lower end cover 70 is fixed to the bottom of the core assembly 10 by snap-fit connection.

Finally, the display 30 is fixed in the display receiving hole 41 by snap-fit connection.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A portable electric inflator comprising:

a core assembly comprising a motor and an air compressing mechanism, the motor configured to drive the air compressing mechanism to compress and discharge air;

a housing defining a receiving space for accommodating the core assembly, and comprising an external surface that defines a display receiving hole and a plurality of through holes communicating with the receiving space;

a cloth in full contact with and covering the external surface of the housing, the cloth defining an opening, an edge of the opening extending from a junction of the display receiving hole and the external surface of the housing into the housing, forming a side surface covering portion that is in contact with an inner side surface of the display receiving hole; and a display received in the display receiving hole, the display comprising a lateral surface abutting against the side surface covering portion.

2. The portable electric inflator of claim 1, further comprising a transmission mechanism, wherein the air compressing mechanism comprises a cylinder, a piston rod received in the cylinder, and a piston rotatably connected to one end of the piston rod, the transmission mechanism is configured to transmit rotary motion from the motor to the piston rod, which enables the piston rod to push the piston to reciprocate in the cylinder to compress and discharge the air in the cylinder.

3. The portable electric inflator of claim 1, wherein the housing comprises a first housing and a second housing that each comprise four edges, a first of the four edges of the first housing is rotatably connected to the a first of the four edges of the second housing, the cloth is in full contact with and covers external surfaces of the first housing and the second housing; the cloth extends from a second of the four edges of the first housing opposite to the first of the four edges of the first housing, a third and a fourth of the four edges of the first housing between the first and the second of the four edges of the first housing to an inner surface of the first housing; the cloth extends from a second of the four edges of the second housing opposite to the first of the four edges of the second housing, a third and a fourth of the four edges of the second housing between the first and the second of the four edges of the second housing to an inner surface of the second housing.

4. The portable electric inflator of claim 3, further comprising a flexible hinge that is configured to rotatably connect the first housing to the second housing.

5. The portable electric inflator of claim 3, wherein the display is detachably connected to the core assembly.

6. The portable electric inflator of claim 3, wherein the first housing comprises a first engaging member on the inner surface thereof adjacent to the second of the four edges of the first housing, the core assembly comprises a counterpart member facing the first engaging member, the first engaging member is engaged with the counterpart member to detachably connect the first housing to the core assembly.

7. The portable electric inflator of claim 4, wherein the flexible hinge defines a plurality of through holes, the first housing and the second housing each comprise a plurality of posts protruding from the inner surfaces thereof, the posts of the first housing and the second housing pass through the through holes of the flexible hinge, respectively, ends of the posts are heat fused to fix the flexible hinge to the first housing and the second housing.

8. A portable electric inflator comprising:

a core assembly comprising a motor, an air compressing mechanism, a circuit board, and a switch, the motor configured to drive the air compressing mechanism to compress and discharge air, the motor and the switch electrically connected to the circuit board, the circuit board configured to execute control of the motor in response to the switch being triggered;

a housing defining a receiving space for accommodating the core assembly, and comprising an external surface that defines a plurality of through holes communicating with the receiving space;

a cloth in full contact with and covering the external surface of the housing, edges of the cloth extending from edges of the housing to an inner surface of the housing; and at least one button comprising a body and a fixing post protruding from the body, the fixing post passing through the cloth and connected to the housing, the button configured to receive a pushing force from a user and transmit the pushing force to the switch to trigger the switch.

9. The portable electric inflator of claim 8, further comprising a transmission mechanism, wherein the air compressing mechanism comprises a cylinder, a piston rod received in the cylinder, and a piston rotatably connected to one end of the piston rod, the transmission mechanism is configured to transmit rotary motion from the motor to the piston rod, which enables the piston rod to push the piston to reciprocate in the cylinder to compress and discharge the air in the cylinder.

10. The portable electric inflator of claim 8, wherein the housing comprises a first housing and a second housing that each comprise four edges, a first of the four edges of the first housing is rotatably connected to the a first of the four edges of the second housing, the cloth is in full contact with and covers external surfaces of the first housing and the second housing; the cloth extends from a second of the four edges of the first housing opposite to the first of the four edges of the first housing, a third and a fourth of the four edges of the first housing between the first and the second of the four edges of the first housing to an inner surface of the first housing; the cloth extends from a second of the four edges of the second housing opposite to the first of the four edges of the second housing, a third and a fourth of the four edges of the second housing between the first and the second of the four edges of the second housing to an inner surface of the second housing.

11. The portable electric inflator of claim 10, further comprising a flexible hinge that is configured to rotatably connect the first housing to the second housing.

12. The portable electric inflator of claim 10, wherein the first housing comprises a first engaging member on the inner surface thereof adjacent to the second of the four edges of the first housing, the core assembly comprises a counterpart member facing the first engaging member, the first engaging member is engaged with the counterpart member to detachably connect the first housing to the core assembly.

13. The portable electric inflator of claim 11, wherein the flexible hinge defines a plurality of through holes, the first housing and the second housing each comprise a plurality of posts protruding from the inner surfaces thereof, the posts of the first housing and the second housing pass through the through holes of the flexible hinge, respectively, ends of the posts are heat-fused to fix the flexible hinge to the first housing and the second housing.

14. The portable electric inflator of claim 8, wherein the housing defines a through hole through which the fixing post passes, and one end of the fixing post is heat fused to connect the at least one button to the housing.

15. A portable electric inflator comprising:

a core assembly comprising a motor and an air compressing mechanism, the motor configured to drive the air compressing mechanism to compress and discharge air;

a housing comprising a first housing and a second housing, the first housing and the second housing corporately define a receiving space for accommodating the core assembly, at least one of the first housing and the second housing defining a plurality of through holes communicating with the receiving space, the first housing comprising a first edge and a second edge opposite to the first edge, the second housing comprising a third edge and a fourth edge opposite to the third edge, the first edge rotatably connected to the third edge;

a cloth in full contact with and covering external surfaces of the first housing and the second housing, the cloth extending from edges of the first housing and the second housing to inner surfaces of the first housing and the second housing, which enables a portion of the cloth covering the second edge and a portion of the cloth covering the fourth edge abut against each other when the first housing and the second housing are in a closed state; and a display connected to the first housing.

16. The portable electric inflator of claim 15, further comprising a transmission mechanism, wherein the air compressing mechanism comprises a cylinder, a piston rod received in the cylinder, and a piston rotatably connected to one end of the piston rod, the transmission mechanism is configured to transmit rotary motion from the motor to the piston rod, which enables the piston rod to push the piston to reciprocate in the cylinder to compress and discharge the air in the cylinder.

17. The portable electric inflator of claim 15, wherein the first edge is rotatably connected to the third edge through a flexible hinge.

18. The portable electric inflator of claim 15, wherein the first housing comprises a first engaging member on the inner surface thereof adjacent to the second of the four edges of the first housing, the core assembly comprises a counterpart member facing the first engaging member, the first engaging member is engaged with the counterpart member to detachably connect the first housing to the core assembly.

19. The portable electric inflator of claim 17, wherein the flexible hinge defines a plurality of through holes, the first housing and the second housing each comprise a plurality of posts protruding from the inner surfaces thereof, the posts of the first housing and the second housing pass through the through holes of the flexible hinge, respectively, ends of the posts are heat-fused to fix the flexible hinge to the first housing and the second housing.

* * * * *